United States Patent [19]

Bell et al.

[11] 4,049,444

[45] Sept. 20, 1977

[54] PROCESS FOR TREATMENT OF LATERITIC ORES

[75] Inventors: Malcolm Charles Evert Bell, Sudbury; Ramamritham Sridhar, Mississauga, both of Canada

[73] Assignee: The International Nickel Company, Inc., New York, N.Y.

[21] Appl. No.: 510,549

[22] Filed: Sept. 30, 1974

[30] Foreign Application Priority Data

Nov. 5, 1973 Canada ..... 185029

[51] Int. Cl.[2] ..... C22B 23/00

[52] U.S. Cl. ..... 75/82; 75/3; 75/21

[58] Field of Search ..... 75/82, 21, 3

[56] References Cited

U.S. PATENT DOCUMENTS

| | | | |
|---|---|---|---|
| 3,365,339 | 1/1968 | Beggs et al. | 7/3 |
| 3,388,870 | 6/1968 | Thumm et al. | 75/21 |
| 3,443,931 | 5/1969 | Beggs et al. | 75/3 |
| 3,503,734 | 3/1970 | Bell | 75/21 |
| 3,503,735 | 3/1970 | Beggs et al. | 75/82 |
| 3,535,105 | 10/1970 | Archibald | 75/21 |
| 3,793,005 | 2/1974 | Kelly et al. | 75/82 |

FOREIGN PATENT DOCUMENTS

| | | | |
|---|---|---|---|
| 449,035 | 11/1972 | Australia | 75/82 |
| 848,377 | 8/1970 | Canada | 75/82 |
| 1,496,632 | 8/1967 | France | |

*Primary Examiner*—M. J. Andrews
*Attorney, Agent, or Firm*—Miriam W. Leff; Ewan C. MacQueen

[57] ABSTRACT

Recovery, by thermal upgrading, of nickel values from nickeliferous lateritic ores containing a silicate fraction is improved by forming agglomerates of the ore, a reagent containing at least one member selected from the group consisting of alkali or alkaline earth metal compounds in a small but effective amount to increase nickel recovery from the silicate fraction and a liquid hydrocarbon in an amount between about 1 and 12%, based on the weight of the ore and heating a static, shallow bed of the agglomerates established on a moving bed to partially melt the agglomerates to reduce and coalesce the nickel values into easily recoverable ferronickel concentrate. The grade of the ferronickel concentrate can be increased by incorporating a sulfur-bearing material in the agglomerates.

18 Claims, 1 Drawing Figure

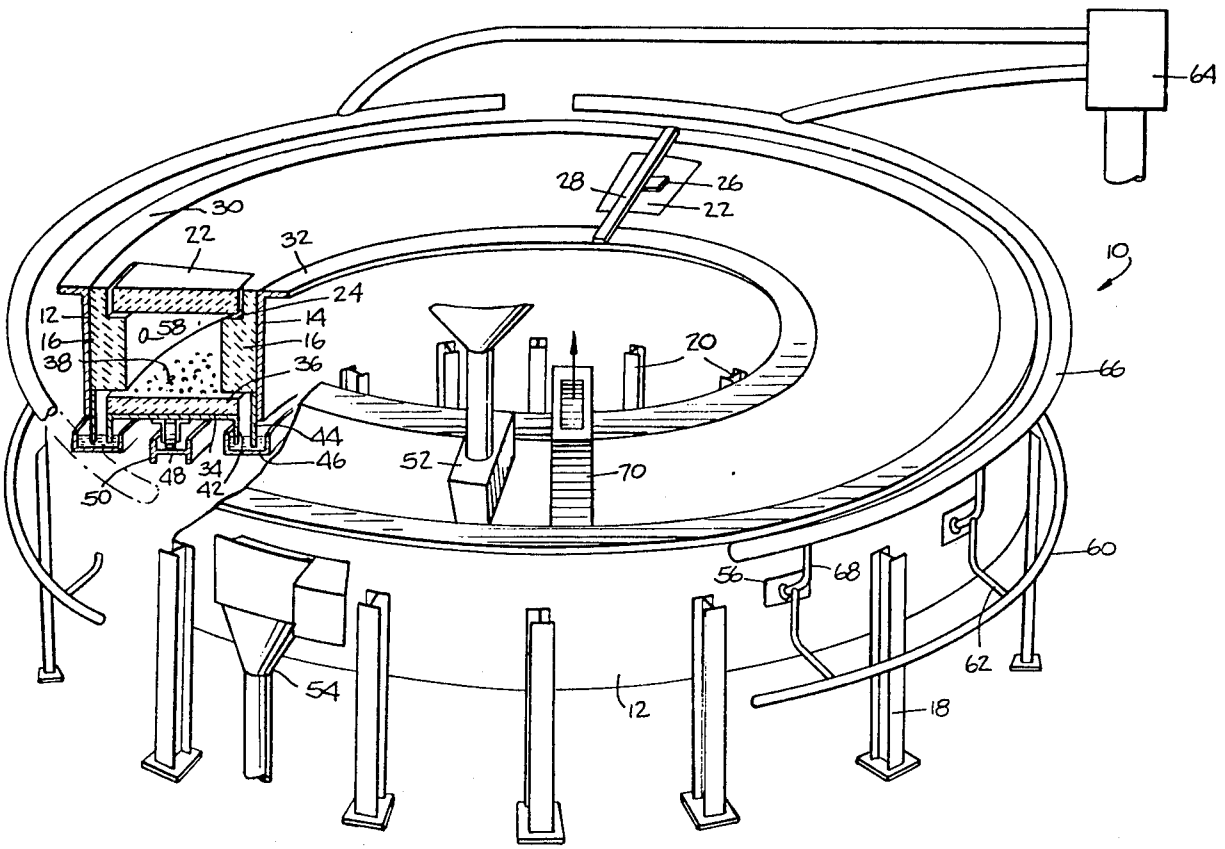
64
10
66
60
62
18
68
56
12
54
52
70
20
26
22
28
24
14
16
36
44
46
32
30
22
34
42
48
58
50
12
16
38

PROCESS FOR TREATMENT OF LATERITIC ORES

The present invention pertains to the treatment of nickeliferous lateritic ores, and more particularly to the thermal upgrading of nickeliferous lateritic ores to provide a high-grade ferronickel concentrate.

Nickeliferous lateritic deposits form some of the largest known reserves of nickel. However, exploitation of these deposits presents many problems because lateritic ores are not susceptible to conventional beneficiation techniques and the entire bulk of the ore must pass through numerous processing stages, consuming large quantities of fuel and chemical reagents, in order to recover generally not more than about 2.5% of the bulk of the ore, the nickel content of most nickeliferous laterites.

It has been proposed to thermally beneficiate nickeliferous lateritic ores by heating the ore with controlled amounts of reductant to produce ferronickel products which can be separated from the gangue by known separation techniques, such as magnetic separation, gravity separation or flotation. In most instances, agglomerates of the finely divided ore and reductant are fed to a countercurrently-fired rotary furnace in which the agglomerates are preheated to reducing temperatures and then held at reducing temperatures under controlled atmospheres to reduce the nickel values contained in the ore and to coalesce the reduced nickel values. Upon discharge from the rotary furnace, the agglomerates are cooled, crushed and subjected to separation techniques to recover a ferronickel product. A major problem encountered by these processes is the ringing of the reactor wall by the sticky hot agglomerates. At times, ringing becomes so severe that processing has to be terminated. In order to minimize the problems associated with such sticking, processing is conducted to minimize ringing while maximizing reduction of the nickel values to metallic nickel and to the coalescence of the reduced nickel values. Because lower reduction temperatures are resorted to to minimize sticking, it is necessary to increase the residence time of the agglomerates in the rotary furnace to promote coalescence of reduced nickel values to facilitate separation of the ferronickel concentrate from the gangue.

Other workers, recognizing that thermal upgrading in rotary kilns involves long residence times at high temperatures with concomitant additional fuel costs, proposed that a static bed of ore agglomerates containing a solid reductant be heated to relatively high temperatures to facilitate reduction and coalescence of nickel values while minimizing reduction times. Although this process works reasonably well, it is primarily a mechanical solution which does not take into account the nature of the ore being treated. And consequently, either nickel recoveries or concentrate grades suffer.

It has now been discovered that nickeliferous lateritic ores containing less than about 38% iron can be thermally upgraded to provide high grade ferronickel concentrates while insuring high nickel recoveries by heating agglomerates of the ore, special reductants and special additives to reduction temperatures that promote coalescence of reduced nickel values.

Objects and advantages of the present invention will become apparent from the following description taken in conjunction with the FIGURE which is a pictorial view, partly sectional, of a rotary hearth furnace that can be employed for thermally upgrading nickeliferous lateritic ores.

Generally speaking, the present invention contemplates a process for thermally upgrading nickeliferous lateritic ores that contain a material silicate fraction. Agglomerates of a finely-divided nickeliferous lateritic ore containing a material silicate fraction, a reagent containing at least one member selected from the group consisting of alkali metal compounds and alkaline earth metal compounds in small but effective amounts to increase nickel recovery, and a liquid hydrocarbon in an amount between about 1% and 12%, based on the weight of the ore, are formed. A static shallow bed of the agglomerates is established on a movable hearth, and the hearth is moved through a confined space having a preheating zone and a reducing zone to heat the agglomerates to their incipient fusion temperature in the reducing zone, the reducing zone having an atmosphere that is at least reducing to nickel oxide, to reduce the nickel values in the ore to metallic nickel and to coalesce the reduced nickel values into ferronickel particles. The ferronickel parties are recovered.

All nickeliferous lateritic ores that contain a substantial silicate fraction can be treated by the process in accordance with the present invention. However, it is advantageous to treat nickeliferous lateritic ores containing at least about 1.4% nickel, e.g., at least about 1.7% nickel. These ores will generally contain iron in amounts of at least about 7% and less than about 40%, e.g., between about 12% and 34% iron, up to about 30% magnesia, e.g., between about 10% and 25%, up to about 55% silica, e.g., between about 10% and 50%, and substantial amounts of moisture, e.g., up to about 40%. Ores within the foregoing ranges have a silicate to limonite ratio of at least about 1:4 and in most instances the silicate to limonite ratio will exceed about 1:3. Cobalt is invariably present in these ores in amounts of up to about 1 part of cobalt for each 10 parts of nickel, and for the purposes of describing the present invention, no distinction will be drawn between nickel and cobalt since cobalt behaves similar to nickel and will be recovered in the ferronickel product.

Effective concentration of the nickel values contained in nickeliferous lateritic ores is promoted by treating ores of agglomerating fineness, employing a separate comminution step, if necessary. Advantageously, the ore has a particle size distribution of at least about 100% minus ¼ inch and most advantageously at least about 100% minus ⅛ inch. The finely divided ores are agglomerated along with the additives described hereinafter by well known techniques such as pelletizing, briquetting, extrusion and balling. The ore is formed into agglomerates having a minimum dimension of at least about 5 millimeters (mm) for both mechanical and chemical considerations.

A liquid hydrocarbon in an amount equal to at least about 1% of the ore is added to the finely divided nickeliferous lateritic ores before pelletizing. Other reductants in addition to the liquid hydrocarbon can be employed but the minimal amount of liquid hydrocarbon must be present to insure both high recoveries and high grade concentrates. The total amount of reductants employed can vary over fairly broad ranges but in order to insure high grade concentrates and optimal fuel consumption the total amount of reductants does not exceed about 12%. Most advantageously, the amount of reductants employed, including the minimal liquid hydrocarbon addition of about 1%, will vary between about 4 and 8%, based upon the weight of the ore, to insure high recoveries and high grade concentrates while minimizing fuel consumption. Although the invention is not limited thereto, it is believed that at the elevated temperatures employed for reducing and diffusing the reduced nickel values the liquid hydrocarbons by both cracking and volatilization produce kinetically active, strongly reducing atmospheres within agglomerates promoting reduction of nickel values at lower temperatures. The advantages gained by employing liquid hydrocarbon can be lost if the liquid hydrocarbon is distilled from agglomerates before the kinetically active, strongly reducing atmosphere generated by the liquid hydrocarbon is effective in reducing the nickel value. Therefore, in order to maximize most of the advantages gained by the use of liquid hydrocarbons, it is advantageous to employ heavy liquid hydrocarbons up to about 24° API. Examples of such liquid hydrocarbons are Bunker 'C' and Bunker 'B' fuel oils. All the beneficial effects of the use of liquid hydrocarbons as reductants are particularly apparent when reduction is conducted in a rotary hearth furnace, as described hereinafter, in which furnace the rapid heating insures that the volatile constituents of the liquid hydrocarbons are effective as reductants and the higher temperatures that can be employed insure that the more stable gaseous hydrocarbons are also effective as reductants.

Nickel recoveries, particularly when treating nickeliferous lateritic ores containing less than about 40% iron, e.g., less than about 25% iron, can be materially improved by adding a reagent to the finely divided ore before agglomeration. The reagent contains a compound of at least one member selected from the group consisting of alkaline metal or alkali earth metals. Examples of such reagents include sodium chloride, potassium chloride, soda ash, sodium sulfate, lime, fluorspar, limestone, calcium sulfate and calcium chloride. It is to be noted that the term alkaline earth metal as used herein does not include magnesium. The reagents are added to the finely divided ore in small but effective amounts to increase nickel recovery from the silicate fraction. Improved nickel recoveries are obtained by employing a reagent in amounts between 1 and 10% and most advantageously in amounts between about 3 and 8%.

In an advantageous embodiment, coalescence of the reduced nickel values is promoted by incorporating a sulfur-bearing material in the agglomerates. The sulfur-bearing material is added to the ore agglomerate in small but effective amounts of less than about 1% to promote concentration of the reduced nickel values into discrete ferronickel particles. The sulfur can be added to the agglomerates in a form of iron pyrites, pyrrhotite, elemental sulfur, sodium sulfate, calcium sulfate, and other sulfur-bearing compounds, as well as the sulfur contained in the reductant. Regardless of the form in which sulfur is added to the agglomerates, the total sulfur content of the agglomerates should not exceed about 1% in order to insure maximum recovery of the ferronickel particles by magnetic separation. However, if flotation is employed for concentrate recovery, sulfur additions up to about 10% can be used. When the total sulfur content of the agglomerate exceeds about 1%, the recovery of nickel as ferronickel particles by magnetic separation is, in most instances, adversely affected. Advantageously, the sulfur content of the agglomerates is maintained between about 0.2 and 0.7%, based on the weight of the agglomerate.

The agglomerates of the finely divided ore, heavy liquid hydrocarbon, reagent and sulfur-bearing material are formed into a shallow static bed on a refractory hearth, and the shallow bed is passed through a confined space to heat the agglomerate to a temperature of at least 1200° C. to reduce and coalesce the nickel values contained in the ore. Advantageously, the agglomerates are heated to a temperature between about 1250° and 1325° C. to reduce and coalesce the nickel values.

Afer reduction, the agglomerates are cooled in a manner to avoid reoxidation of the reduced metal values. After cooling, the agglomerates are crushed and the crushed ore is subjected to magnetic separation or flotation to recover at least about 75% of the nickel, e.g., at least about 80% of the nickel, as a ferronickel concentrate containing at least about 8%, e.g., at least about 10%, nickel. Magnetic separation can be accomplished by any well known means. Nickel recovery can be maximized by multistage magnetic separation, by multistage flotation or by a combination of magnetic separation and flotation. The concentrate from magnetic separation or flotation can be sulfided and/or smelted and then converted to produce a nickel matte product or a ferronickel product.

Advantageously, the process in accordance with the present invention is conducted in a rotary hearth furnace as depicted in the accompanying FIGURE. The furance includes concentrical circular steel walls 12 and 14 that are lined with a suitable refractory 16. Rotary hearth furnace 10 is supported by beams 18 and 20 fixedly mounted to walls 12 and 14. The top of furnace 10 can be lined with suitable refractories 22 that form a gas seal with shoulders 24 of refractory 16. Refractory 22 can be suspended by support means 26 and rod 28 which rests on flanges 30 and 32 of walls 12 and 14.

The rotary hearth is an annular shaped steel plate 34 lined with refractory 36 on which a static bed of feed agglomerates 38 is carried. Vertical flanges 42 and 44 are submerged in water trough 46 to form a gas field. Rotary hearth 34 is also provided with steel wheel 48 that rides in thrust bearings 50 when the rotary hearth 34 is rotated by means not shown in the FIGURE. Ore agglomerates are fed to rotary hearth furnace 10 via feed hopper 52, and reduced ore agglomerates are discharged by discharge mechanism 54.

Rotary hearth furnace 10, including refractories 16, 22 and 36, is heated by combustion of a fuel with a free-oxygen-containing gas in a plurality of burners 56 which discharge the products of combustion into the furnace via ports 58. Fuel, either gas or oil, is fed to burners 56 by gas header 60 and conduit 62 while free-oxygen-containing gas to support combustion is distributed to burners by blower 64 through headers 66 and conduit 68. Fuel and free-oxygen-containing gases are combusted by burners 56 to generate sufficient heat to maintain the static bed of ore agglomerates 38 at operating temperatures, and to produce atmospheres having controlled reducing potentials above the static bed. Advantageously, the ratio of fuel to free-oxygen-containing gases fed to the burners is controlled to provide an atmosphere above the bed of ore agglomerates that is at least reducing to nickel oxide especially in the reduction zone. Spent atmosphere is discharged via exhaust ducts 70. Advantageously, the confined space formed by refractories 36, 16 and 22 is provided with a baffle between discharge mechanism 54 and charging mechanism 52 in order to establish a flow of the products of combustion countercurrent to the movement of the rotary hearth. The countercurrent flow of the products of combustion insures efficient utilization of the generated heat and the maintenance of proper reducing conditions within the reducing zone.

In operation, ore agglomerates are fed to feed hopper 52 and then to refractory 36 to form a shallow bed of the ore agglomerates and rotary hearth 34 is rotated in a counterclockwise direction. In a preferred embodiment, agglomerates in feed hopper 52 or in any other suitable vessel are preheated by the gases discharged by exhaust duct 70. The shallow bed of ore agglomerates 38 is heated to a temperature between about 1200° and 1325° C. by convection and radiation from refractory linings 16, 22 and 36. Fuel, such as natural gas, and a free-oxygen-containing gas, such as air, are combusted in a plurality of burners 56 and the products of combustion are discharged into the rotary hearth furnace via burner ports 58 to generate sufficient heat to maintain bed 38 at operating temperatures. The products of combustion are discharged from the furnace via exhaust port 70 and reduced ore agglomerates are discharged into discharge hopper 54.

For the purpose of giving those skilled in the art a better understanding of the invention the following illustrative examples are given:

EXAMPLE I

Samples of minus 48 mesh nickeliferous lateritic ore containing 1.7% nickel and 15.3% iron, i.e., a silicate to limonite ratio of 4:1, were mixed with Bunker C fuel oil and with various reagents for increasing nickel recovery. The mixtures of ore, oil and reagent were briquetted. The briquettes were formed into a static, shallow bed and heated to 1300° C. at which temperature partial melting, as evidenced by the briquettes having rounded corners, slumping under their own weight and incipient flow, was observed. The conditions in this laboratory scale test were determined to simulate treatment in a rotary hearth furnace with a moving bed. After 20 minutes at temperature, the briquettes were cooled to room temperature under non-oxidizing conditions, and the cooled briquettes were ground to 95% minus 325 mesh. The ground ore was subjected to magnetic separation using a Davis tube. The results are reported in Table I in which the weight percent of the magnetic concentrate refers to the proportion of the concentrate to the calcined briquettes and nickel recovery is based on the nickel in the ore.

In order to show the effects of the reagent on nickel recovery, another test conducted in a similar manner except that a higher reduction temperature and long reduction priods were used, i.e., ore briquetted without any reagent but with a liquid hydrocarbon was heated to 1320° C. for 30 minutes. The results for this comparative test are also reported in Table I.

Comparison of the results on Table I confirms that the use of lime or sodium chloride dramatically increases nickel recovery from nickeliferous lateritic ores containing a substantial silicate fraction.

TABLE I

| Reagent[1] | Bunker 'C' Oil[1] | Temp. ° C. | Time min. | Magnetic Conc. Wt % | Magnetic Conc. % Ni | Magnetic Conc. % Fe | Recovery % Ni |
|---|---|---|---|---|---|---|---|
| 5 % NaCl | 7% | 1300 | 20 | 18.3 | 9.0 | 40.7 | 86 |
| 5 % CaO | 7% | 1300 | 20 | 11.2 | 15.2 | 21.8 | 87 |
| none | 8% | 1320 | 30 | 4.1 | 15.8 | 26.4 | 37 |

[1]Additions given on a weight basis based on the weight of the ore.

EXAMPLE II

Minus 48 mesh nickeliferous lateritic ore containing 2.1% nickel, 23.6% iron, 13.7% magnesia, 32% silica, other minor gangue and moisture (i.e., a silicate to limonite ratio of about 1.47:1) was mixed with 5% Bunker C fuel oil and 3% charcoal, 0.5% sulfur and 3% limestone, all based on the weight of the ore. The mixture was briquetted and fed to a rotary hearth furnace at a rate of 800 pounds per hour. Natural gas was combusted with 67% aeration in a burner at the discharge portion of the furnace to establish a countercurrent flow of gases through the furnace. The gas temperature was 2500° F. The residence time in the furnace for the briquettes was approximately 20 minutes. After cooling, the briquettes were ground to minus 325 mesh and magnetically separated in a Davis tube operated at 4800 gauss. The results are reported in Table II.

To illustrate the importance of adding a reagent, in this instance limestone, even to ores having lower silicate fractions, a similar test was conducted except that no limestone was incorporated in the briquettes. The result of this test is reported in Table II.

The results in Table II confirm that limestone is effective in improving nickel recovery from ores containing a substantial silicate fraction. The results in Table II also confirm that the combination of limestone and sulfur increases the grade of the concentrate.

TABLE II

| Bunker 'C' Wt % | Charcoal Wt % | Sulfur Wt % | Limestone Wt % | Magnetic Concentrate Ni % | Nickel Recovery % |
|---|---|---|---|---|---|
| 5 | 3 | 0.5 | 3 | 16 | 88 |
| 5 | 3 | 0.5 | 0 | 14 | 82 |

It is to be noted that all solid and liquid compositions given herein are on a weight basis unless otherwise expressly stated. Gaseous compositions are taken on a volumetric basis.

EXAMPLE III

Nickeliferous oxide ore containing, on a dry basis, 1.63% nickel, 0.11% cobalt, 33.8% iron, 12% magnesia, 16.4% silica and the balance essentially moisture and other gangue (a silicate to limonite ratio of 1:2.8) and having a particle size distribution of minus ⅛ inch was briquetted with different reductants and with and without fluxes to demonstrate the improved results obtained with liquid hydrocarbons rather than solid carbon and the beneficial effects of fluxes. The type and the amount of additives employed in each test are given in Table III.

The briquetted ore was heated to 1295° C. for 20 minutes in an atmosphere simulating combustion of natural gas at 60% aeration. Under these conditions which were designed to simulate treatment in a shallow moving bed, nickel, cobalt and iron were reduced and coalesced into particles readily separable by magnetic separation.

After being cooled, the briquettes were ground to minus 325 mesh, and the coalesced particles were recovered by magnetic separation with a Davis tube operated at 4800 gauss. The results are given in Table III.

The results presented in Table III confirm that nickel recoveries are significantly improved when liquid hydrocarbons are used as reductants (i.e., nickel recoveries are increased to approximately 93% with liquid hydrocarbons from 80% with coal). The results in Table III also demonstrate that the use of a flux increases the grade of the nickel concentrate, regardless of the type of reductant employed. Lastly, the results in Table III confirm that cobalt recoveries are improved when liquid hydrocarbons are used as reductants.

TABLE III

| Weight % of Ore | | | | | | | | | |
|---|---|---|---|---|---|---|---|---|---|
| Anthracite coal | Bunker C oil | Sulfur | $CaCO_3$ | Magnetic Concentrate(2) Wt.%(1) | % Ni | % Co | % Fe | Recovery % Ni | % Co |
| 6 | — | 1 | — | 11.8 | 12.7 | 0.58 | 53.3 | 80.6 | 58.6 |
| — | 6 | 1 | 2 | 11.8 | 14.4 | 0.77 | 62.1 | 92.8 | 75.8 |
| — | 6 | 1 | — | 15.7 | 11.7 | 0.64 | 63.5 | 92.7 | 79.0 |

(1)By weight of calcine
(2)Produced by grinding calcine to -325 mesh, and magnetic separation at 4800 gauss.

Reference to the Examples show that the agglomerates were treated at a temperature in the range of about 1295° to about 1320° C. The tests also show that the high recoveries could be effected by subjecting the agglomerates to such temperatures for a period of time of up to 30 minutes, e.g. 20 minutes in Example I and a total residence time in the furnace (including heat-up) of about 20 minutes in Example II, which makes the time at temperature for the agglomerates in Example II less than 20 minutes.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. In a thermal upgrading process for treating nickeliferous lateritic ores containing a silicate to limonite ratio of at least about 1:4 which comprises: forming agglomerates of the particulate nickeliferous lateritic ore, a reducing agent and a reagent containing at least one member selected from the group consisting of alkali metal compounds and alkaline earth metal compounds; heating said agglomerates to reduce nickel values in the ore to metallic nickel and to coalesce the reduced nickel values into ferronickel particles; the improvement comprising: employing said reducing agent in the agglomerates in an amount of up to about 12% by weight, said reducing agent containing at least about 1% by weight liquid hydrocarbon, the amount of reducing agent based on the weight of the ore, utilizing said reagent in a small but effective amount for improved nickel recovery up to about 10%; establishing a shallow bed of the agglomerates on a movable hearth; moving the shallow bed of agglomerates successively and rapidly through a confined space having a preheating zone and a reducing zone having an atmosphere at least reducing to nickel oxide while subjecting the agglomerates to a temperature of between about 1295° and about 1320° C for a period of up to about 30 minutes to partially melt the agglomerates, to reduce nickel values to metallic nickel, and to coalesce the reduced nickel values into ferronickel particles; thereby permitting continuous treatment of said nickeliferous lateritic ore containing a substantial silicate fraction at temperatures above the softening temperature of the agglomerates and achieving a nickel recovery of at least over 80%.

2. The process as described in claim 1 wherein the nickeliferous lateritic ore has an iron content between about 7 and 40%.

3. The process as described in claim 1 wherein the nickeliferous lateritic ore has an iron content between about 12 and 34%.

4. The process as described in claim 2 wherein a solid reductant is incorporated in the agglomerates to provide the agglomerates with a total reductant addition between about 4 and 8%, based on the weight of the ore.

5. The process as described in claim 2 wherein the reagent is incorporated in the agglomerates in an amount between about 1 and 10%.

6. The process as described in claim 2 wherein the reagent is incorporated in the agglomerates in an amount between about 3 and 8%.

7. The process as described in claim 2 wherein a sulfur-bearing material is incorporated in the agglomerates in small but effective amounts to promote concentration of reduced nickel values into discrete ferronickel particles.

8. The process as described in claim 7 wherein the ferronickel particles are recovered by magnetic separation.

9. The process as described in claim 8 wherein multistage magnetic separation is employed.

10. The process as described in claim 7 wherein the ferronickel particles are recovered by flotation.

11. The process as described in claim 10 wherein multistage flotation is employed.

12. The process as described in claim 7 wherein the ferronickel particles are recovered by a combination of flotation and magnetic separation.

13. The process as described in claim 7 wherein the sulfur is added in amounts of less than about 1% to insure maximum recovery of the ferronickel particles by magnetic separation.

14. The process as described in claim 7 wherein the sulfur is added in amounts between about 0.2 and 0.7% to insure maximum recovery of the ferronickel particles by magnetic separation.

15. The process as described in claim 10 wherein sulfur is added in amounts between about 1% and 10% to promote substantial sulfiding of the ferronickel particles to maximize recovery of nickel by flotation.

16. The process as described in claim 2 wherein the concentrate is melted to produce a ferronickel product.

17. The process as described in claim 2 wherein the concentrate is sulfided and/or smelted and converted to produce a nickel matte product.

18. In a thermal upgrading process for treating nickeliferous lateritic ores having a high silicate to limonite ratio and containing above 24% up to about 40% iron, which comprises: forming agglomerates of the particulate nickeliferous lateritic ore and a reducing agent, heating said agglomerates to reduce nickel values in the ore to metallic nickel and to coalesce the reduced nickel values into ferronickel particles; the improvement comprising: employing said reducing agent in the agglomerates in an amount of up to about 12% by weight, said reducing agent containing at least about 1% by weight liquid hydrocarbon, the amount of reducing agent being based on the weight of the ore, adding to the agglomerates at least one reagent selected from the group consisting of alkali metal compounds, alkaline earth metal compounds and sulfur, said reagent being added in a small but effective amount for improved nickel recovery up to about 10%; establishing a shallow bed of the agglomerates on a movable hearth; moving the shallow bed of agglomerates successively and rapidly through a confined space having a preheating zone and a reducing zone having an atmosphere at least reducing to nickel oxide while subjecting the agglomerates to a temperature of between about 1295° and about 1320° C for a period of time of up to about 30 minutes to partially melt the agglomerates, to reduce nickel values to metallic nickel, to to coalesce the reduced nickel values into ferronickel articles; thereby permitting continuous treatment of said nickelferous lateritic ore containing a substantial silicate fraction at temperatures above the softening temperature of the agglomerates and achieving a nickel recovery of at least above about 80%.

* * * * *